US010669718B2

(12) United States Patent
Pryor et al.

(10) Patent No.: US 10,669,718 B2
(45) Date of Patent: Jun. 2, 2020

(54) ONE-PIECE STRUCTURAL FUSE

(71) Applicant: Simpson Strong-Tie Company Inc., Pleasanton, CA (US)

(72) Inventors: Steven E. Pryor, Dublin, CA (US); Timothy S. Ellis, Thousand Oaks, CA (US); Brandon Y. Chi, Oakland, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

(21) Appl. No.: 15/935,412

(22) Filed: Mar. 26, 2018

(65) Prior Publication Data

US 2019/0292783 A1 Sep. 26, 2019

(51) Int. Cl.

| | |
|---|---|
| ***E04C 3/00*** | (2006.01) |
| ***E04C 3/04*** | (2006.01) |
| ***E04C 3/38*** | (2006.01) |
| ***E04B 1/24*** | (2006.01) |
| ***E04H 9/02*** | (2006.01) |

(52) U.S. Cl.

CPC ..... *E04C 3/04* (2013.01); *E04B 1/2403* (2013.01); *E04C 3/38* (2013.01); *E04H 9/024* (2013.01); *E04B 2001/2415* (2013.01); *E04B 2001/2442* (2013.01); *E04B 2001/2448* (2013.01); *E04C 2003/0452* (2013.01)

(58) Field of Classification Search

CPC ..... E04C 3/04; E04C 2003/0452; E04C 3/38
USPC ..... 52/481.1, 745.19
See application file for complete search history.

(56) References Cited

U.S. PATENT DOCUMENTS

| | | | | |
|---|---|---|---|---|
| 2,201,826 A | | 5/1940 | Ditchfield | |
| 3,716,957 A | * | 2/1973 | Bernardi | E04B 1/5812 52/633 |
| 5,595,040 A | * | 1/1997 | Chen | E04B 1/2403 52/167.1 |
| 6,739,099 B2 | * | 5/2004 | Takeuchi | E04B 1/2403 403/403 |
| 7,178,296 B2 | * | 2/2007 | Houghton | E04B 1/24 52/167.3 |
| 2004/0244330 A1 | * | 12/2004 | Takeuchi | E04B 1/2403 52/831 |
| 2005/0257451 A1 | * | 11/2005 | Pryor | E04B 1/2403 52/167.4 |

(Continued)

FOREIGN PATENT DOCUMENTS

EP 2468986 A2 6/2012

OTHER PUBLICATIONS

International Search Report and Written Opinion dated Jun. 19, 2019 in International Patent Application No. PCT/US2019/023406.

*Primary Examiner* — Beth A Stephan
(74) *Attorney, Agent, or Firm* — Vierra Magen Marcus LLP

(57) ABSTRACT

A one-piece structural fuse assembly is disclosed that is formed from a single piece of structural steel such as a beam. In embodiments, a first flange of the beam may form the fuse base, and a portion of the web of the beam may form the fuse plate. Additionally, a buckling restraint plate of the structural fuse assembly may be formed from a second flange of the beam, and the spacers of the structural fuse assembly may be formed from a portion of the web unused by the fuse plate. In examples, all of the components cut from the single piece of the beam are used in a single structural fuse assembly.

16 Claims, 9 Drawing Sheets

(56) References Cited

U.S. PATENT DOCUMENTS

| | | | | |
|---|---|---|---|---|
| 2006/0144006 | A1* | 7/2006 | Suzuki | E04B 1/2403 52/655.1 |
| 2007/0011971 | A1* | 1/2007 | Sitkiewicz | E04B 2/767 52/481.1 |
| 2007/0175149 | A1* | 8/2007 | Bodnar | B21D 19/00 52/481.1 |
| 2011/0308190 | A1* | 12/2011 | Pryor | E04B 1/2403 52/653.1 |
| 2017/0067249 | A1* | 3/2017 | Matteson | E04B 1/985 |

* cited by examiner

ONE-PIECE STRUCTURAL FUSE

BACKGROUND

Structural fuses are known for use in homes, buildings and other structures for dissipating stresses in the structural connections and frames upon seismic, wind or other loads on the structures. For example, the Yield-Link® structural fuse from Simpson Strong-Tie, Pleasanton, Calif., may be used at a connection of a beam to a column so that, when loads on the structural connection reach a threshold, the structural fuse yields to dissipate energy without damage to the beam or column. Thereafter, the damaged structural fuse may be removed and replaced without having to otherwise repair the connection.

A typical structural fuse includes a base and a plate welded orthogonally to the base. The plate may include a midsection having a smaller diameter than ends of the plate, the midsection designed to be the area where yielding occurs. In use, the base may be bolted to a column. A first surface of the yield plate may rest against a surface of the beam, with an end of the yield plate bolted to the beam. A planar buckling restraint plate (BRP) on a second surface of the yield plate, opposite the first surface, may be bolted through the yield plate and into the beam to prevent buckling of the plate under compressive loads. Spacers may be provided in the smaller diameter midsection of the yield plate to evenly distribute loads on the plate and the BRP, when the BRP is bolted to the beam.

Currently, the fuse base, fuse yield plate, buckling restraint plate and spacers are all formed from different pieces of steel, each having different properties. Moreover, welding of the fuse base to the fuse plate needs to be a complete joint penetration (CJP) weld, which are difficult welds to perform and subject to imperfections. Even if done correctly, the weld is less ductile than the other portions of steel in the structural fuse, and can abruptly fail before yielding of the structural fuse at the midsection.

SUMMARY

The present technology relates to a one-piece structural fuse assembly formed from a single piece of structural steel such as an I-beam or standard structural W-shape beam. Initially, a section, or blank, may be cut from a beam. The blank may be severed transverse to the length of the beam, so that the blank includes first and second flanges connected by a web. In embodiments, the first flange of the blank may form the fuse base, and a portion of the web of the blank may form the fuse yield plate. Additionally, in embodiments, the buckling restraint plate may be formed from the second flange of the blank, and the spacers may be formed from a portion of the web unused in the fuse yield plate. In embodiments, all of the components cut from the single blank are used in a single structural fuse assembly.

In one example, the present technology relates to a pair of structural fuse assemblies, comprising: a first blank taken from a first section of beam, the first blank comprising: a first structural fuse comprising; a first fuse base formed from a first flange of the beam, a first fuse yield plate extending from and integrally formed with the fuse base, the fuse plate formed from a web of the beam, and the fuse yield plate comprising a narrow area defined by a pair of notches; a first pair of spacers formed from the web of the beam and configured to fit within the pair of notches; and a first buckling restraint plate formed from a second flange of the beam; and a second blank taken from a second section of beam, the second blank comprising: a second structural fuse comprising; a second fuse base formed from the first flange of the beam, a second fuse yield plate extending from and integrally formed with the fuse base, the fuse plate formed from a web of the beam, and the fuse yield plate comprising a narrow area defined by a pair of notches; a second pair of spacers formed from the web of the beam and configured to fit within the pair of notches; and a second buckling restraint plate formed from a second flange of the beam; wherein the first and second sections of beam are directly adjacent each other on the beam.

In another example, the present technology relates to a structural fuse assembly, comprising: a structural fuse comprising; a fuse base, a fuse yield plate extending from and integrally formed with the fuse base, the fuse yield plate comprising a narrow area defined by a pair of notches; a pair of spacers for fitting within the pair of notches; and a buckling restraint plate; wherein the structural fuse, the pair of spacers and the buckling restraint plate all come from a single section of a structural steel component.

In a further example, the present technology relates to a structural fuse assembly, comprising: a blank taken from a section of a beam, the blank comprising: a structural fuse comprising; a fuse base formed from a first flange of the beam, a fuse yield plate extending from and integrally formed with the fuse base, the fuse plate formed from a web of the beam, and the fuse yield plate comprising a narrow area defined by a pair of notches; a pair of spacers formed from the web of the beam and configured to fit within the pair of notches; and a buckling restraint plate formed from a second flange of the beam.

In another example, the present technology relates to a structural fuse assembly, comprising: a blank taken from a section of a beam, the blank comprising: a structural fuse comprising; a fuse base formed from a first flange of the beam, and a fuse yield plate extending from and integrally formed with the fuse base, the fuse plate formed from a web of the beam.

In a further example, the present technology relates to a method of fabricating a structural fuse assembly, the method comprising: (a) cutting a blank from a structural steel component including at least a first flange and a web extending orthogonally from the first flange and integrally formed with the first flange; (b) forming the first flange of the blank into a fuse base of the structural fuse assembly; and (c) forming the web of the blank into a fuse yield plate of the structural fuse assembly.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION

Figure 1:
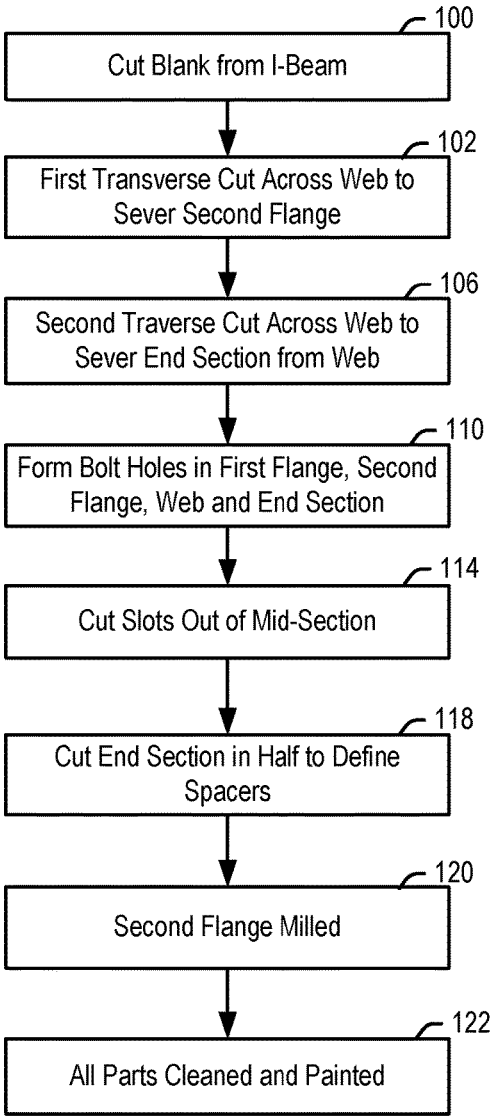
FIGS. 1 and 2 are flowcharts of methods for fabricating a one-piece structural fuse according to embodiments of the present technology.

The present technology, roughly described, relates to a one-piece structural fuse assembly formed from a single piece of structural steel such as an I-beam, a wide-flange I-beam or a standard structural W-shaped beam. The structural fuse assembly may include a structural fuse having a fuse base and a fuse plate, a pair of spacers and a buckling restraint plate (BRP). Initially, a blank may be cut from a beam transverse to the length of the beam, so that the blank includes first and second flanges connected by a web. In embodiments, the first flange of the blank may form the fuse base, and a portion of the web of the blank may form the fuse plate. Additionally, in embodiments, the BRP may be formed from the second flange of the blank, and the spacers may be formed from a portion of the web unused in the fuse plate. In embodiments, all of the components cut from the single blank are used in a single structural fuse assembly.

Forming some or all of the components used in a structural fuse assembly from a single piece of a beam provides several advantages. First, having the fuse base integrally formed with the fuse plate avoids the need for a complete joint penetration weld, thus removing the possibility of human error in forming the weld, and brittleness at the weld site. Second, it is important that the spacers be the same thickness as the fuse plate to within a tight tolerance, such as for example 0.15 inches. Forming the spacers and the fuse plate from the same web ensures this tight tolerance is met. Third, when steel is heated in a certain way, a grain of the steel may align to polar north. Forming the structural fuse assembly from a piece of steel where all of the grain is aligned ensures uniform properties and response across the entire structural fuse assembly.

It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

The terms "top" and "bottom," "upper" and "lower" and "vertical" and "horizontal" as may be used herein are by way of example and illustrative purposes only, and are not meant to limit the description of the invention inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±0.25%.

FIG. 1 is a flowchart of one embodiment for forming a structural fuse assembly according to the present technology. A structural fuse assembly is initially taken from a conventional structural steel component such as a beam 200, shown in FIG. 3. The beam 200 may have first and second flanges 202 and 204, respectively, and a web 206 extending between the first and second flanges. In one example, the flanges 202, 204 may have a thickness of 1 13/16 inches, though the thickness of the flanges may vary in further embodiments. In one example, the web 206 may have a thickness of 1 inch, ¾ inch or ½ inch, though the thickness of the web may vary in further embodiments. The beam 200 may have a maximum width (from the exterior surfaces of flanges 202, 204) of 40 3/16 inches, though this width may vary in further embodiments.

Figure 4:
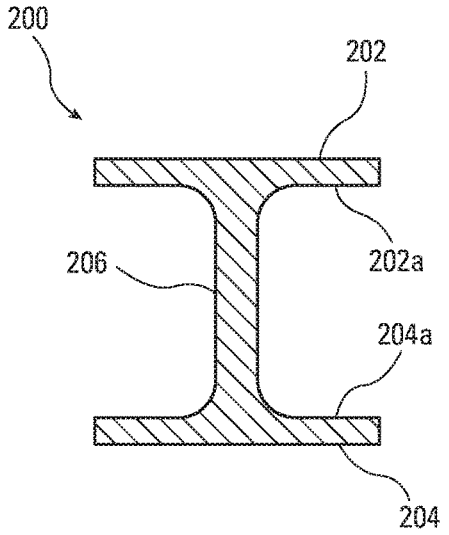
FIGS. 4 and 5 show cross-sectional views of different configurations of a beam from which a one-piece fuse according to the present technology may be fabricated.
Figure 5:
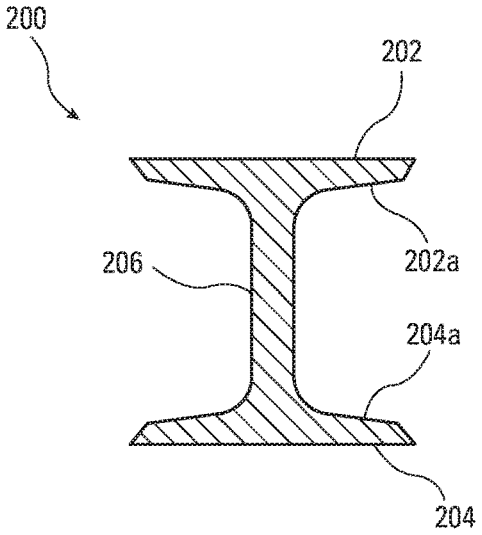

The flanges may be formed in a so-called standard structural W-shape, where interior surfaces 202*a*, 204*a* of the flanges 202 and 204 are orthogonal to the surfaces of the web 206 (FIG. 4). Alternatively, the flanges may be formed in a so-called S-section, where the interior surfaces 202*a*, 204*a* form an angle greater than 90° with the surfaces of the web 206 (FIG. 5). Other configurations of beams are contemplated. As explained below, the first and second flanges 202, 204 form the fuse base and BRP, respectively, in the finished structural fuse assembly. However, it is conceivable that the BRP not come from the same piece of steel as the structural fuse. In such an embodiment, the structural fuse may be formed from a structural steel component having a single flange instead of a conventional beam having two flanges.

Figure 3:
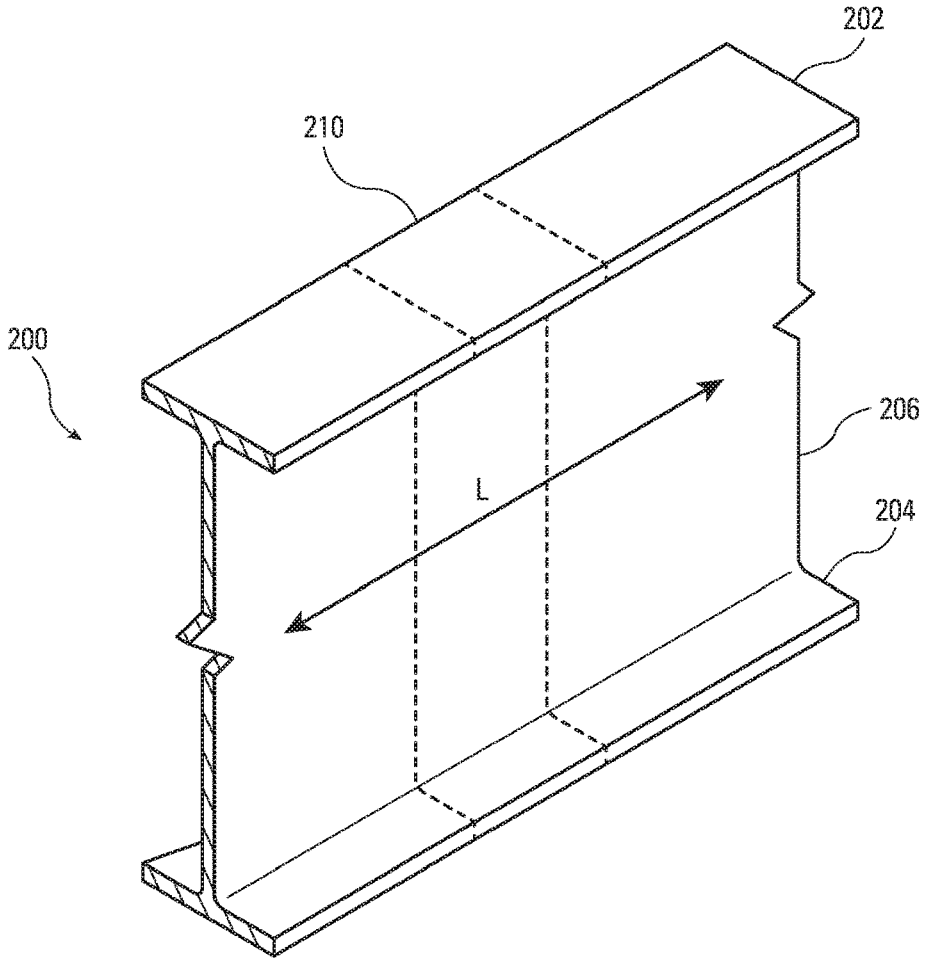
FIG. 3 shows a section of a beam from which multiple structural fuses may be fabricated according to embodiments of the present technology.
Figure 6:
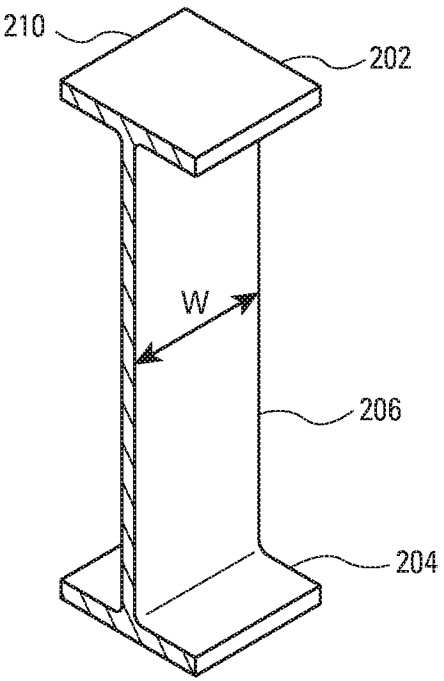
FIG. 6 shows a section of a beam from which a one-piece structural fuse according to embodiments of the present technology may be fabricated.

In step 100, a section of the beam 200 is cut from the beam in a direction transverse to a length (L, FIG. 3). This section, referred to herein as blank 210, is indicated in FIG. 3 and is shown in FIG. 6. Blank 210 includes first flange 202, second flange 204 and web 206. As shown in FIG. 6, the blank 210 may have a width, W, of 12 inches, but this width may vary in further embodiments. The blank 210 may be cut from beam 200 by various methods including for example computer numeric control (CNC) plasma cutting. The PythonX robotic plasma cutting system by Burlington Automation Corp. of Ontario Canada is one example of such a cutting system. Other cutting methods such as by saw blade are possible.

Figure 7:
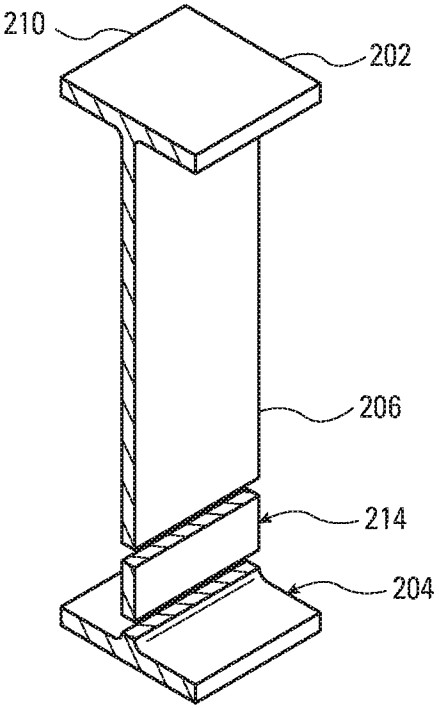
FIGS. 7 and 8 illustrate the beam of FIG. 6 severed into discrete sections forming the structural fuse, spacers and buckling restraint plate.
Figure 8:
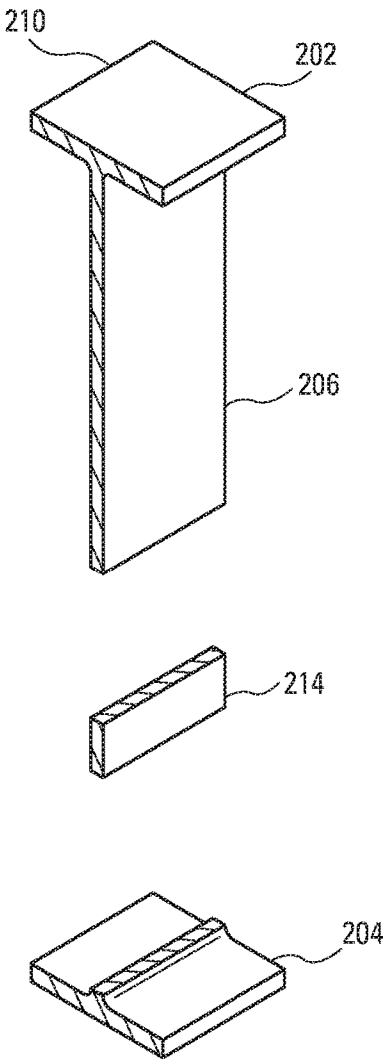

In step 102, a first transverse cut is made adjacent to the second flange 204 to separate the flange 204 from the web 206 (FIGS. 7 and 8). As explained below, the separated second flange 204 may be processed into the BRP in the structural fuse assembly. In step 106, a second transverse cut is made near an end portion of web 206 to separate a section 214 from the web 206 (FIGS. 7 and 8). As explained below, in one embodiment, the section 214 may be processed into a pair of spacers in the structural fuse assembly. The first and second transverse cuts may be made by CNC plasma cutting, by a cutting blade or other cutting methods.

Figure 9:
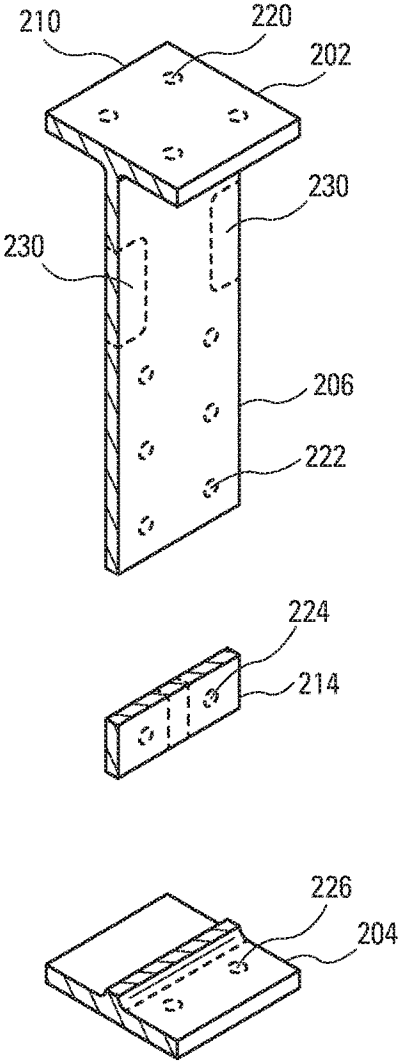
FIGS. 9 and 10A show cuts, holes and other processing which may be performed on the structural fuse, spacers and buckling restraint plate.

In step 110, bolt holes may be formed in the first flange 202, the second flange 204, the web 206 and/or the section 214. For example, as shown in FIG. 9, bolt holes 220 may be formed in the first flange 202, bolt holes 222 may be formed in web 206, bolt holes 224 may be formed in section 214 and bolt holes 226 may be formed in the second flange 204. The particular arrangement of bolt holes in the different components is by way of example, and the location and size of the holes may vary in alternative embodiments. The holes 220, 222, 224 and 226 may be formed by various methods including by the True Hole® hi-definition plasma cutting system from Hypertherm, Inc. of New Hampshire, USA. The holes 220, 222, 224 and 226 may be formed by other methods including drilling in further embodiments.

Figure 10B:
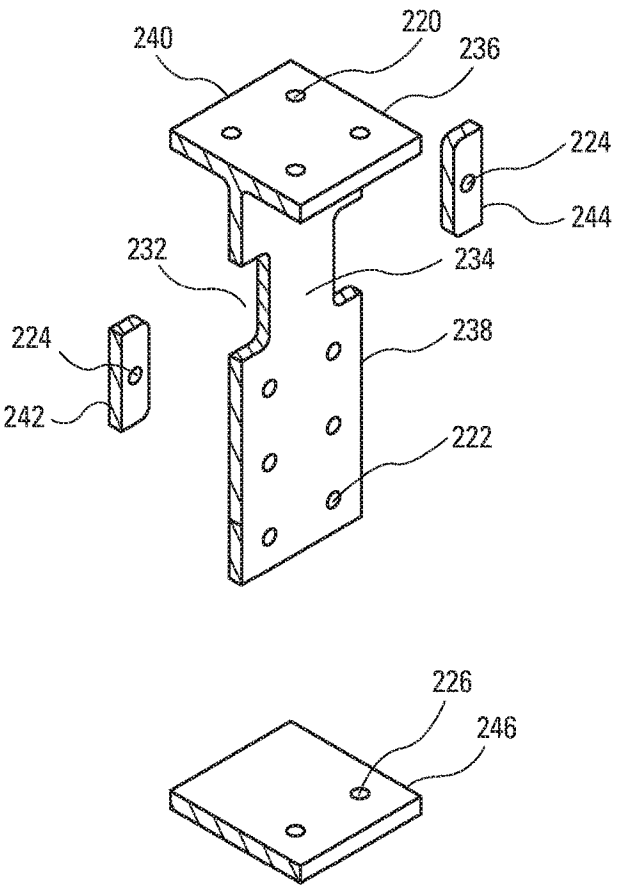
FIG. 10B shows cuts, holes and other processing which may be performed on the structural fuse, spacers and buckling restraint plate according to an alternative embodiment.
Figure 10A:
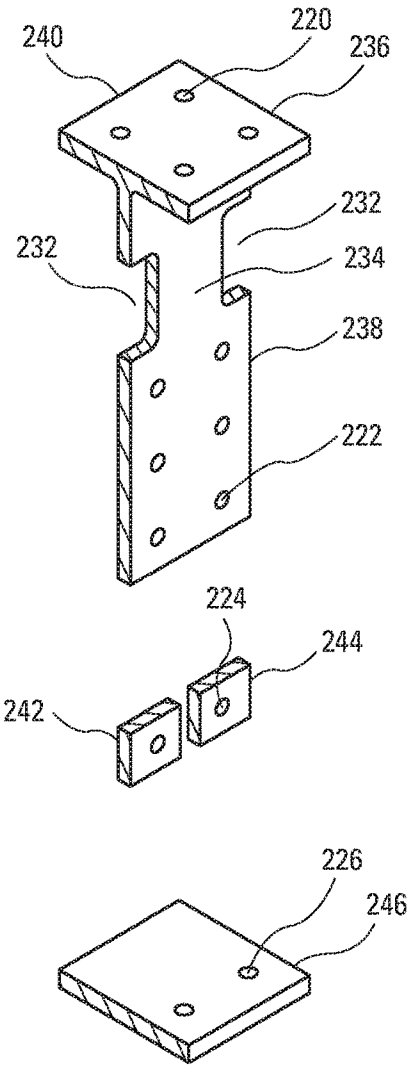

In step 114, portions 230 may be removed from web 206 to define notches 232 (FIG. 10A). The notches form a narrow-width area 234. This narrow-width area 234 is the area of the finished structural fuse that yields upon loads above some predefined threshold. The notches 232 may be cut from the web 206 by various methods including for example by CNC plasma cutting as explained above. Other cutting methods such as by saw blade are possible. At this point, the first flange 202 has been processed into a fuse base 236 (FIG. 10A), and the web 206 has been processed into a fuse yield plate 238. The fuse base 236 and fuse yield plate 238 together form structural fuse 240.

In step 118, section 214 may be cut in half to define a pair of spacers 242 and 244 (FIG. 10A). Spacers 242 and 244 are used within the structural fuse assembly as explained hereinafter. In step 120, the second flange 204 may be milled or otherwise processed to remove any portion of the web 206 remaining when the second flange 204 was severed from the web 206. The milling or processing transforms the second flange 204 into a planar buckling restraint plate (BRP) 246 as shown in FIG. 10A. A portion of the web is left remaining to help metal composite decking bear on the yield-link connection by gravity alone.

In the embodiment described above, the spacers 242 and 244 are taken from a section of the web 206 beyond the end of the fuse yield plate 238. However, in a further embodiment shown in FIG. 10B, the spacers 242 and 244 may be the portions 230 removed from the web 206 to define notches 232. The spacers 242 and 244 in FIG. 10B may be smaller than the notches 232 by the kerf width of the cut made to remove the portions 230 from the web 206. In further embodiments, the spacers 242 and 244 may be ground or otherwise made smaller so as to ensure they fit within notches 232 without contacting the sides of the yield plate 238. In the embodiment of FIG. 10B, the bolt holes 224 may be formed in the portions 230 (before or after being separated from the web 206). In this embodiment, any portion of the web 206 unused by the fuse yield plate 238 (i.e. between the end of the fuse plate 238 and the second flange 204) may be severed from the web 206 and discarded.

After formation of the structural fuse 240, spacers 242, 244 and BRP 246, all parts may be cleaned and painted or powder coated, for example with PMS 172 orange, in step 122. Step 122 may include blasting the respective components to remove any slag from plasma or other elevated temperature cutting processes. It may also remove scale which may result from the rolling fabrication process of the beam 200. The cleaning step 122 may also remove rust from the components 240, 242, 244 and 246.

Possibly depending on the type of process used to form the structural fuse 240, spacers 242, 244 and BRP 246, it is understood that a number of the above-described steps may be performed in a different order. For example, it is understood that the sequence of steps including the first transverse cut (step 102), the second transverse cut (step 106), the formation of the bolt holes (step 110), and the formation of the notches (step 114) maybe performed in any order in further embodiments.

Figure 2:
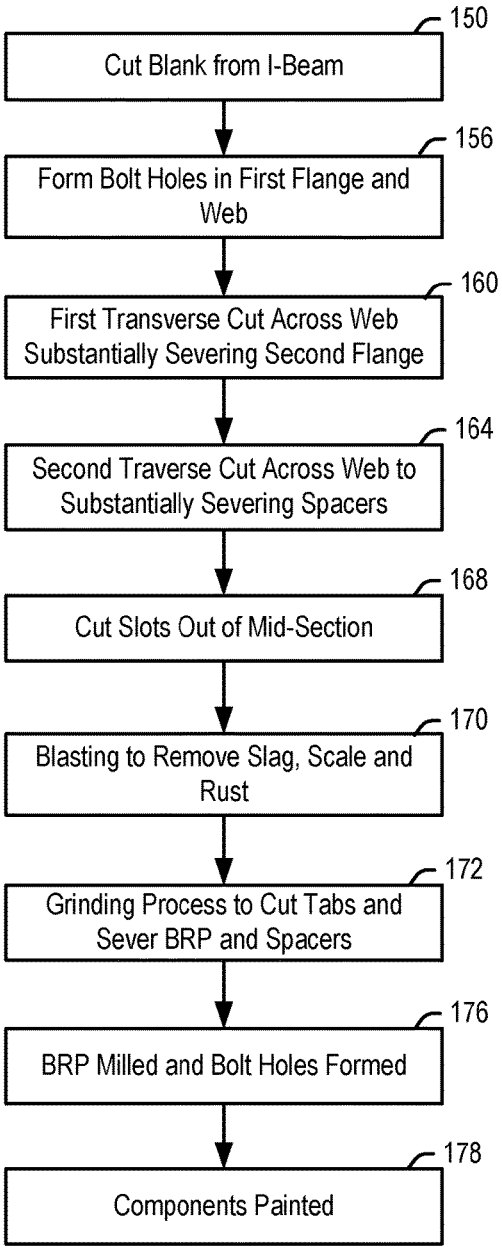

As noted, one process for forming the structural fuse 240, spacers 242, 244 and BRP 246 may involve plasma cutting and hole forming. FIG. 2 shows an alternative method which may be used with such processes. It is understood that the process steps of FIG. 2 may be used with other processes, such as for example mechanical cutting and milling of the structural fuse 240, spacers 242, 244 and BRP 246. In step 150 the blank 210 may be cut from a beam 200 as described above. In step 156, bolt holes may be formed in the first flange 202 and the web 206. In step 160, a first transverse cut may be made across web 206 adjacent the second flange 204 substantially severing the second flange 204. In particular, a small tab may be left connecting the second flange 204 to the web 206 after the first transverse cut is completed. The tab holds the second flange 204 on the web so that the blank 210 remains as one piece.

In step 164, a second transverse cut is made at an end portion of web 206 to substantially separate the section 214 from the web 206. In particular, a second small tab may be left connecting the end portion to the web 206 after the second transverse cut is completed. Thus, the second flange remains attached to the end portion by the first tab, and the end portion remains attached to the web by the second tab. A reason for the use of the tabs to maintain the blank as a single piece after the first and second transverse cuts is so that a technician does not need to retrieve severed pieces from the elevated temperature plasma cutting equipment. As explained below with reference to FIG. 15, in embodiments, two adjacent blanks 210 are used at the top and bottom of a given beam/column connection. Tabs may also be used to keep the two adjacent blanks 210 together.

In step 168, the notches may be cut in the web 206 to define the narrow width area 234 shown in FIGS. 10A and 10B. In step 170, the blank 210 (still in one piece) may undergo a blasting or other cleaning process to remove slag, scale and/or rust from the blank 210. In step 172, the tabs may be removed in a grinding, cutting or other process to sever the structural fuse 240, the spacers 242, 244 and the BRP 246 into separate pieces. As explained below, embodiments of the present technology use a pair of structural fuses cut from adjacent blanks 210. In such embodiments, tabs may further be maintained between adjacent blanks to ensure the pair is kept together.

In step 176, the BRP 246 may be milled to remove any remnants of the web 206 to form the BRP into a planar plate, and the bolt holes may be formed in the BRP. Thereafter, in a step 178, the structural fuse 140, the spacers 242, 244 and the BRP 246 may optionally be painted.

Figure 11:
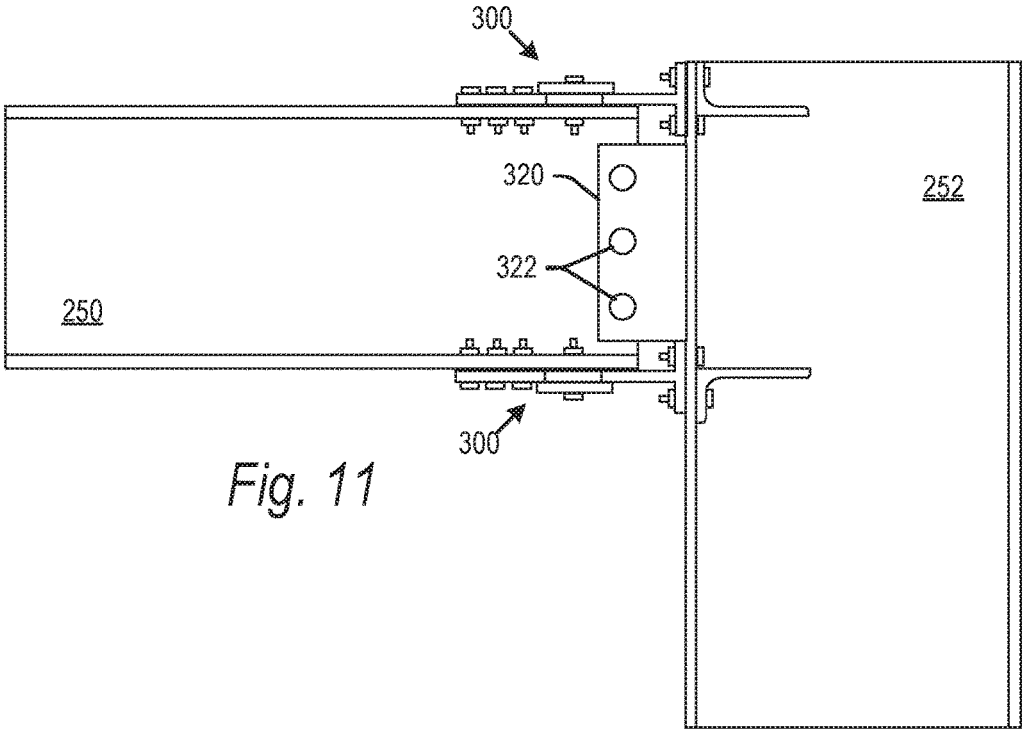
FIG. 11 shows a pair of one-piece structural fuses according to embodiments of the present technology used at a connection between a beam and column in a structure.
Figure 12:
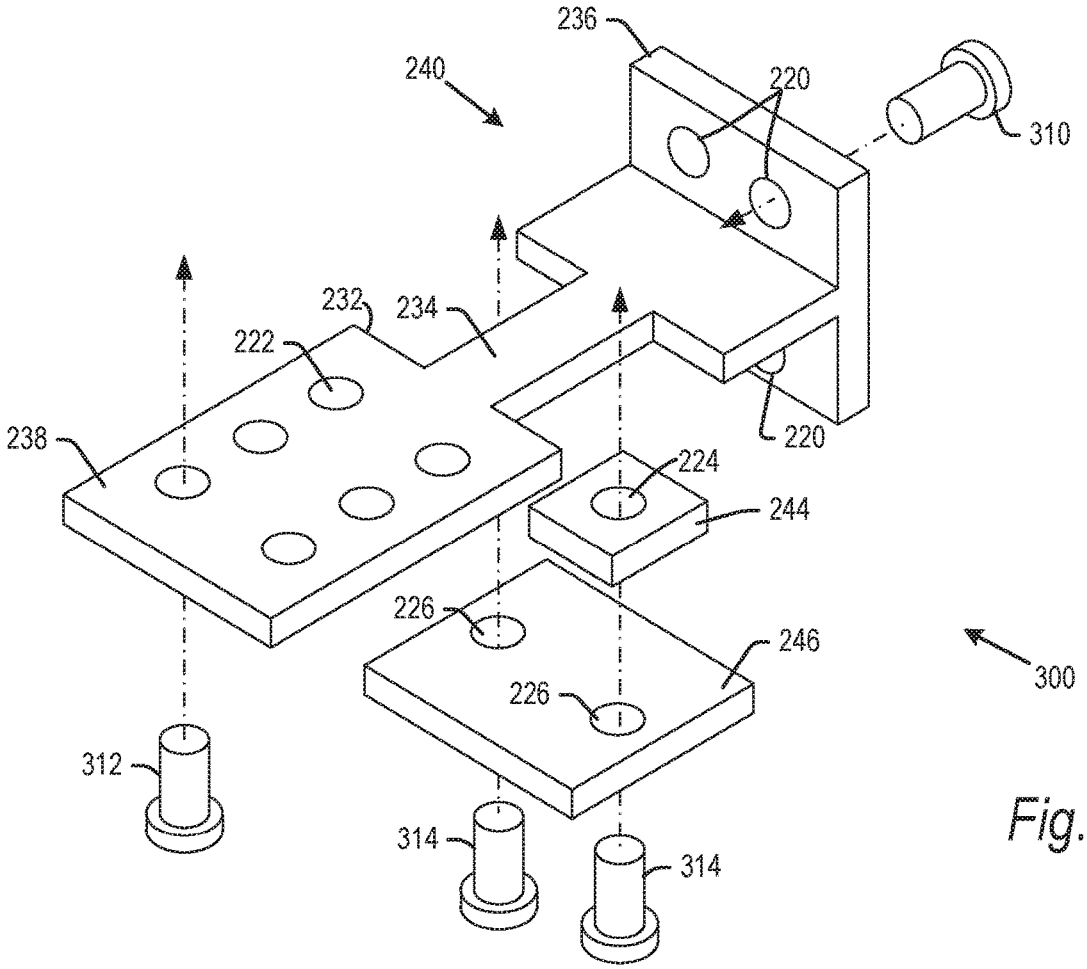
FIG. 12 shows an exploded perspective view of one of the structural fuses of FIG. 11.

FIG. 11 shows a beam 250 connected to the column 252 by a pair of structural fuse assemblies 300 according to the present technology. FIG. 12 illustrates an exploded perspective view of a structural fuse assembly 300 used in the connection of FIG. 11. As shown in FIG. 11, a structural connection, such as the connection of beam 250 to column 252, may include a pair of structural fuse assemblies 300, one at the top of the beam and one at the bottom. In operation, the pair of structural fuse assemblies 300 operate in tandem to oppose rotation of the beam relative to the column under a lateral load. Attempted rotation in a first direction will place the first of the assemblies 300 in tension and the second assembly 300 in compression. Attempted rotation in the opposite direction will place the second assembly 300 in tension and the first assembly 300 in compression.

As shown in FIGS. 11 and 12, each structural fuse assembly 300 includes a structural fuse 240 having a column-mounted fuse base 236 and a beam-mounted fuse yield plate 238. As noted above, unlike conventional structural fuses, the fuse base 236 is integrally formed with the fuse yield plate 238 from a single section of a beam or other structural steel component. As noted, complete joint penetration welds conventionally used to affix the fuse plate to the fuse base are difficult to form. Forming the fuse base and fuse plate from a single piece of structural steel omits the need to form the complete joint penetration weld, and omits the possibility of human error in forming such a weld. Additionally, as a conventional structural fuse is brittle at the weld site, the one-piece integrated structural fuse of the present technology is more ductile than conventional structural fuses.

In embodiments, the structural fuse assembly 300 further includes the BRP 246 and the pair of spacers 242, 244 (one of which is omitted from FIG. 12 for clarity). However, in further embodiments, it is understood that a structural fuse assembly 300 may be defined to include only the structural fuse 240 by itself; only the structural fuse 240 and the spacers 242, 244; or only the structural fuse 240 and the BRP 246.

In order to affix a structural fuse assembly 300 between a beam 250 and column 252, the fuse base 236 may initially be affixed to the column 252, either at the jobsite or remote from the jobsite. As noted above, the fuse base 236 may include bolt holes 220 (FIG. 12) for receiving bolts 310 (one of which is shown in FIG. 12) to bolt the fuse base 236 to the column. While four bolt holes 220 are indicated, there may be more or less bolt holes 220 in further embodiments. While bolts may be preferable, it is contemplated that the fuse base 236 may alternatively be affixed to the column 252 by welding or gluing.

Thereafter, at the jobsite, the beam-mounted fuse yield plate 238 may be bolted to the beam 250 via a plurality of bolts 312 (one of which is shown in FIG. 12) through bolt holes 222. While the figures show six bolts holes 222, there may be more or less than that in further embodiments. At this point, the structural fuse 240 is affixed to both the beam 250 and column 252. The beam and column may also be attached to each other by a shear tab 320. Shear tab 320 may be affixed to the column 252 as by welding, gluing or bolting to a flange of column 252 and to the web of beam 250 as by bolts 322. In further embodiments, the fuse yield plate 238 may initially be mounted to a beam 250, at the jobsite or remotely, and thereafter, the fuse base 236 may be affixed to a column 252 at the jobsite.

The BRP 246 may next affixed to beam 250 over the narrow width area 234 of the fuse yield plate 238. As seen for example in FIG. 12, a pair of bolts 314 fit through bolt holes 226 in BRP 246, into holes formed in a flange of the beam 250, where the bolts may receive a nut to fasten the bolts in place. In order to prevent stresses within the BRP 246 and fuse yield plate 238, the spacers 242, 244 cut from the web may fit within the notches 232 formed in the plate 238. Thus, the bolts 314 fit through bolt holes 226 in BRP 246, up through holes 224 in the spacers 242, 244, and into the holes formed in a flange of the beam 250. The spacer 242, 244 take up at least a substantial portion of the notches 232 on either side of yield plate 338. It is important that the spacers 242, 244 have the same thickness as the fuse yield plate 238 to tight tolerances, such as for example to within 0.15 inches. As the fuse yield plate 238 and spacers 242, 244 are cut from the same blank 210 in accordance with the present technology, the yield plate and spacers may have the same thickness to within the desired tolerances.

The respective structural fuse assemblies 300 shown in FIG. 11 provide high initial stiffness and tensile resistance to relative movement between structural members such as the beam 250 and column 252 under lateral loads, but provides stable yielding and energy dissipation under lateral loads above a predictable, controlled and predefined level. In particular, the bending strength of the column and beam could be designed to exceed the moment capacity of the pair of structural fuse assemblies 300, and in particular, the narrow width areas 234 of the fuse yield plates 238. Thus, the fuse yield plates 238 yield under lateral loads before yielding or failure of the column or beam, and any damage is limited to the fuse yield plates which may be easily removed and replaced. The BRPs 246 prevent buckling of the structural fuse plates 238 under a compressive load. The shear tab 320 is provided to oppose vertical shear (i.e., along the length of column 252) under a vertical load.

It is understood that the components of the structural fuse assembly 300 may have different dimensions within the scope of the present technology. However, the following are examples of some dimensions. The fuse base may have a length of 12 inches, and a width of 10 inches. The fuse yield plate may extend from the fuse base halfway along the width of the fuse base. To the extent the final width of the fuse base differs from the width of the beam 200 from which the fuse base comes, unused portions of the beam 200 above and below the width of the fuse base may be cut and discarded, for example by CNC plasma cutting.

The fuse yield plate may have a width of 12 inches and a length of 36 inches. The narrow width areas 234 may be spaced 6 inches from the fuse base, and may have a length of 12 inches. The narrow width areas 234 may have a width of 6 inches. The spacers 242, 244 may be any length and width that fill at least a substantial portion of the notches defined by the narrow width areas 234. The BRP 246 may have a length and width of 12 inches. As mentioned, each of the above dimensions may vary, proportionately and disproportionately with each other, in further embodiments of the technology.

In embodiments, all components in a structural fuse assembly 300 may come from the same blank 210. Thus, in embodiments where a structural fuse assembly 300 comprises a structural fuse 240, spacers 242, 244 and BRP 246, each may come from the same blank 210. In embodiments where a structural fuse assembly 300 comprises a structural fuse 240 and spacers 242, 244, each may come from the same blank 210 (with the BRP 246 coming from another blank or other structural component). In embodiments where a structural fuse assembly 300 comprises a structural fuse 240 and BRP 246, each may come from the same blank 210 (with the spacers 242, 244 coming from another blank or other structural component). In embodiments where the structural fuse 300 comprises a structural fuse 240 alone, the spacers 242, 244 and/or BRP 246 may come from another blank or other structural component.

In fabrication, multiple blanks 210 may be cut from a length of beam 200. The components from each blank (a structural fuse 240, spacers 242, 244 and/or BRP 246) may each be uniquely marked, or otherwise separated/distinguished from the components coming from another blank 210, to ensure components from a single blank are used together in a finished structural fuse assembly 300.

In embodiments, structural fuse assemblies 300 from blanks 210 taken from anywhere on a beam may be used as the top and bottom assemblies 300 shown in FIG. 11. However, in further embodiments, components from two adjacent blanks may be used in two structural fuse assemblies 300 that are used together at the same connection. For example, the pair of structural fuse assemblies 300 shown at the beam/column connection in FIG. 11 may come from blanks that were adjacent to each other on the beam 200. This ensures that the structural fuse assemblies 300 at the top and bottom of a beam/column connection have the same characteristics and exhibit the same stress responses.

Figure 15:
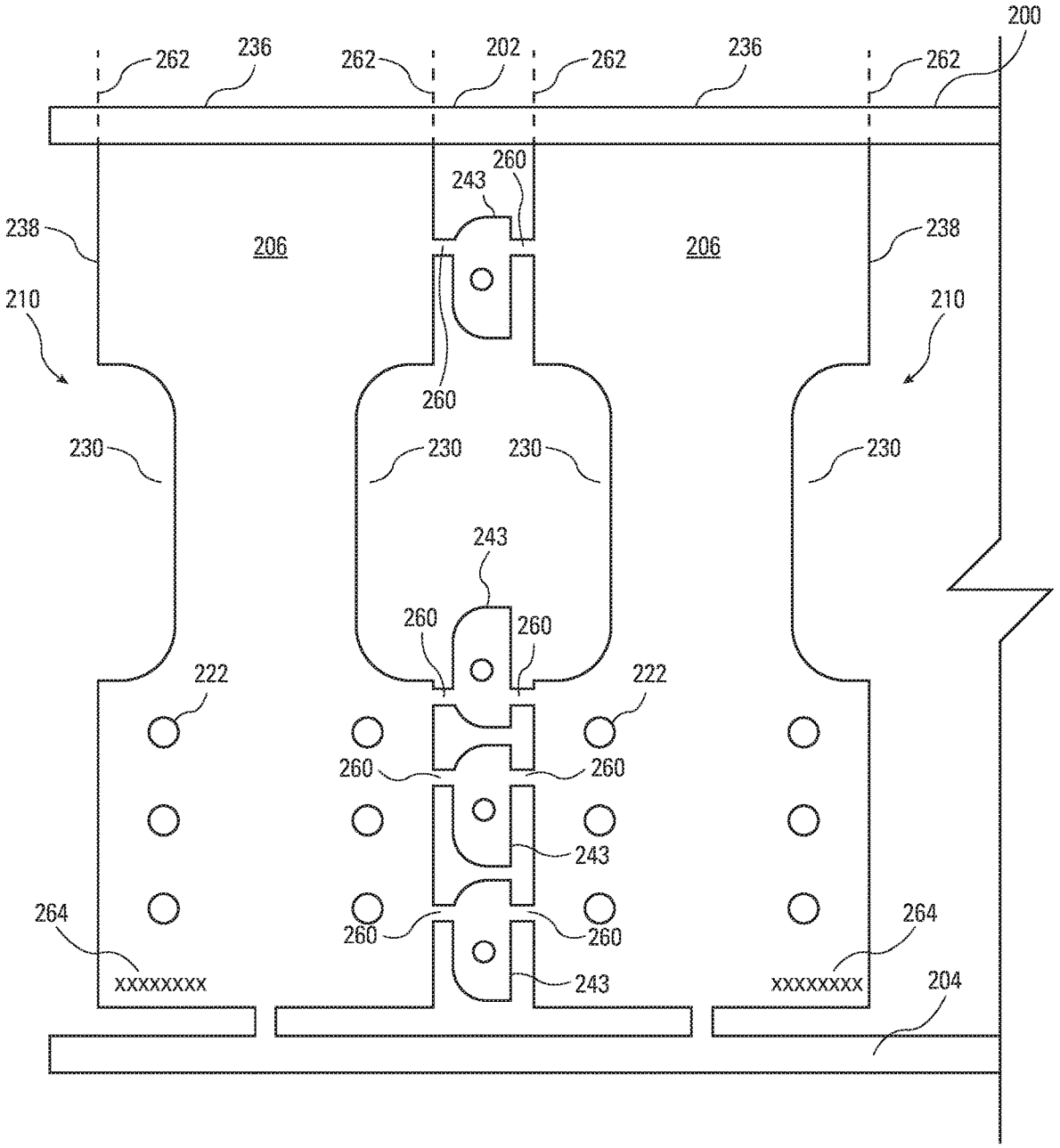
FIG. 15 shows a pair of adjacent blanks used together according to a further embodiment of the present technology.

An embodiment in which adjacent blanks 210 may be used together at the top and bottom of a beam/column connection is shown for example in FIG. 15. FIG. 15 shows blanks 210 formed into the fuse base 236 (formed from flange 202) and fuse yield plate 238 (formed from web 206). The blanks 210 are further cut at web 206 as explained above to form the notches 230 and bolt holes 222. The spacers 242, 244 may be cut as described above. Alternatively, the spacers may be formed between the adjacent blanks 210, such as spacers 243 shown in FIG. 15. The two blanks 210 may be affixed to the flange 202. The two blanks may also be attached to each other and the second flange 204 using tabs 260. In order to separate the blanks from each other and beam 202, the flange 202 may be cut along dashed lines 262, and the tabs 260 may be cut, punched or otherwise removed. An identifier 264 (shown symbolically with "x"s in FIG. 15) may be eteched or otherwise applied to blanks 210. The identifiers 264 on the adjacent blanks 210 may be the same to ensure that these two blanks are used together at the top and bottom of a beam/column connection.

Figure 13:
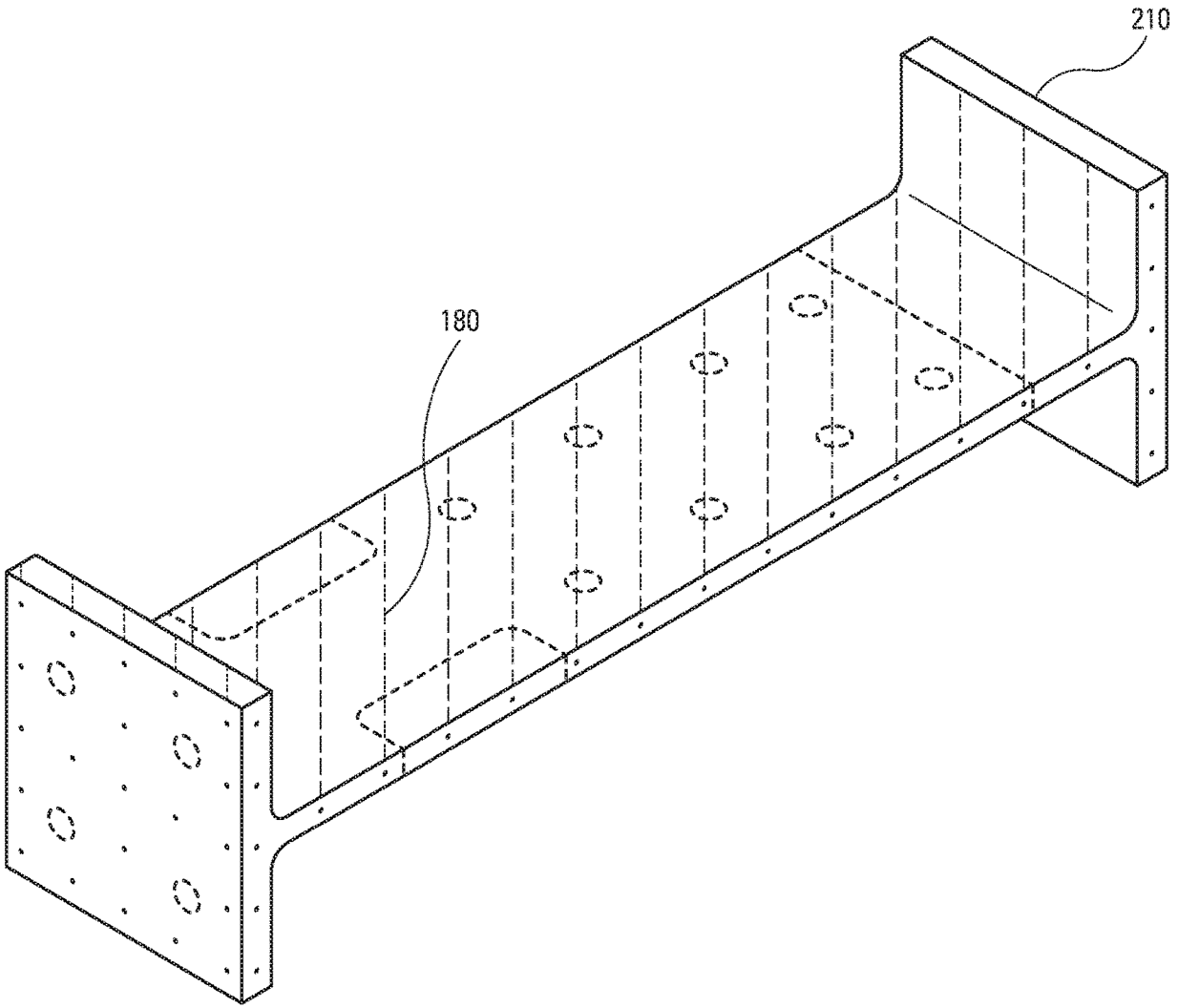
FIG. 13 shows a blank from which components of the structural fuse assembly are formed according to embodiments of the present technology.
Figure 14:
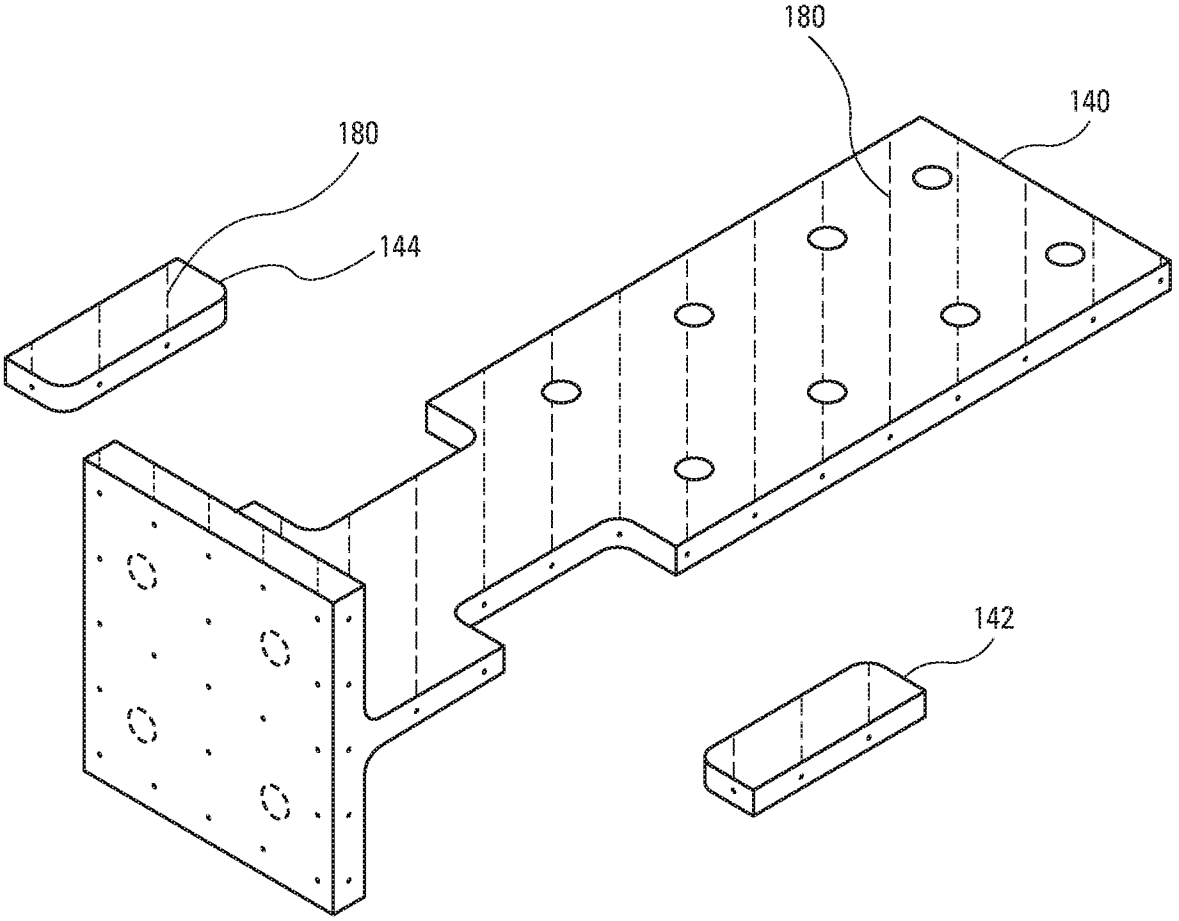
FIG. 14 shows the components of FIG. 13 separated from the blank according to embodiments of the present technology.

As noted above, when steel is heated to at least a predefined temperature, crystals in the steel can align in the same direction to give the steel a grain. It is an advantage of the present technology that the grain of components used in the structural fuse assembly 300 may be aligned with each other. FIG. 13 shows a blank 210 with the crystalline grain 180 shown. As seen, the grain aligns in the same direction. FIG. 14 shows the blank of FIG. 13 processed into a structural fuse 300, including spacers 242, 244 cut from the notches 232. In such an embodiment, when the spacers 242, 244 are returned to the notches in the finished structural fuse 300, the grain 180 of the spacers aligns with grain 180 in the fuse yield plate 238. This advantageously ensures that the properties of the spacers, and the response to stresses by the spacers, will be the same as that of the fuse yield plate 238. The use of two yield link assemblies 300 from adjacent blanks at the top and bottom of a beam/column connection may be more significant than the use of spacers and yield plates from the same blank.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A pair of structural fuse assemblies, comprising:

a first blank taken from a first section of a beam, the first blank comprising:

a first structural fuse comprising;

a first fuse base formed from a first flange of the beam, a first fuse yield plate extending from and integrally formed with the fuse base, the fuse plate formed from a web of the beam, and the fuse yield plate comprising a narrow area defined by a pair of notches;

a first pair of spacers formed from the web of the beam and configured to fit within the pair of notches; and a first buckling restraint plate formed from a second flange of the beam; and a second blank taken from a second section of the beam, the second blank comprising:

a second structural fuse comprising;

a second fuse base formed from the first flange of the beam, a second fuse yield plate extending from and integrally formed with the fuse base, the fuse plate formed from a web of the beam, and the fuse yield plate comprising a narrow area defined by a pair of notches;

a second pair of spacers formed from the web of the beam and configured to fit within the pair of notches; and a second buckling restraint plate formed from a second flange of the beam;

wherein the first and second sections of the beam are directly adjacent each other on the beam.

2. The structural fuse assembly of claim 1, wherein the beam is a structural steel component with a standard structural W-shape.

3. The structural fuse assembly of claim 1, wherein a grain of the pair of spacers aligns with a grain of the fuse yield plate upon positioning the pair of spacers in the pair of notches.

4. A structural fuse assembly, comprising:

a structural fuse comprising;

a fuse base, a fuse yield plate extending from and integrally formed with the fuse base, the fuse yield plate comprising a narrow area defined by a pair of notches;

a pair of spacers for fitting within the pair of notches; and a buckling restraint plate;

wherein the structural fuse, the pair of spacers and the buckling restraint plate all come from a single section of a structural steel component; and wherein a grain of the pair of spacers aligns with a grain of the fuse yield plate upon positioning the pair of spacers in the pair of notches.

5. The structural fuse assembly of claim 4, wherein the structural steel component is a standard structural W-shape beam.

6. The structural fuse assembly of claim 4, wherein the structural steel component is standard structural W-shape beam and wherein the fuse base is formed from a flange of the beam and the fuse yield plate is formed from a web of the beam.

7. The structural fuse assembly of claim 6, wherein the flange comprises a first flange, and wherein the buckling restraint plate is formed from a second flange of the beam.

8. The structural fuse assembly of claim 6, wherein the pair of spacers are formed from the web of the beam.

9. The structural fuse assembly of claim 8, wherein the pair of spacers are formed from a portion of the web cut out to form the notches.

10. The structural fuse assembly of claim 8, wherein the flange is a first flange, and wherein the pair of spacers are formed from a portion of the web between and end of the structural fuse yield plate and a second flange of the beam.

11. A structural fuse assembly, comprising:

a blank taken from a section of a beam, the blank comprising:

a structural fuse comprising:

a fuse base formed from a first flange of the beam, a fuse yield plate extending from and integrally formed with the fuse base, the fuse yield plate comprising a narrow section defined by a pair of notches in opposed edges of the fuse yield plate, the fuse yield plate formed from a web of the beam, and a pair of spacers configured to fit within the pair of notches;

wherein a grain of the pair of spacers aligns with a grain of the fuse yield plate upon positioning the pair of spacers in the pair of notches.

12. The structural fuse assembly of claim 11, the blank further comprising a buckling restraint plate formed from a second flange of the beam.

13. The structural fuse assembly of claim 11, further comprising a buckling restraint plate.

14. The structural fuse assembly of claim 11, wherein the buckling restraint plate comes from the beam.

15. The structural fuse assembly of claim 11, wherein the fuse yield plate comprises a narrow area defined by a pair of notches, the structural fuse assembly further comprising a pair of spacers configured to fit within the pair of notches.

16. The structural fuse assembly of claim 15, wherein the pair of spacers are formed from the web of the beam.

* * * * *